United States Patent [19]

Tsutsumi

[11] 4,399,774

[45] Aug. 23, 1983

[54] APPARATUS FOR CONTROLLING TEMPERATURE OF INTERNAL COMBUSTION ENGINE

[75] Inventor: Saburo Tsutsumi, Yokohama, Japan

[73] Assignee: Nissan Motor Co., Ltd., Yokohama, Japan

[21] Appl. No.: 162,643

[22] Filed: Jun. 24, 1980

[30] Foreign Application Priority Data

Jul. 2, 1979 [JP] Japan ..... 54-82599

[51] Int. Cl.[3] ..... F01P 3/20

[52] U.S. Cl. ..... 123/41.1; 123/556; 123/568; 123/421; 123/196 AB

[58] Field of Search ..... 123/41.02, 41.08, 41.09, 123/41.10, 41.13, 41.31, 41.33, 556, 196 AB, 421, 424, 568

[56] References Cited

U.S. PATENT DOCUMENTS

| | | | |
|---|---|---|---|
| 2,622,572 | 12/1952 | Nallinger | 123/41.13 |
| 4,027,643 | 6/1977 | Feenan et al. | 123/196 AB |
| 4,031,869 | 6/1977 | Onishi et al. | 123/421 |
| 4,079,715 | 3/1978 | Masaki et al. | 123/41.02 |
| 4,177,776 | 12/1979 | Kawai et al. | 123/421 |
| 4,186,560 | 2/1980 | Frankl | 123/556 |
| 4,207,848 | 6/1980 | Dinger et al. | 123/556 |
| 4,231,331 | 11/1980 | Suzuki et al. | 123/568 |
| 4,258,676 | 3/1981 | Lamm | 123/556 |
| 4,274,385 | 6/1981 | Yuzawa et al. | 123/568 |

FOREIGN PATENT DOCUMENTS

| | | | |
|---|---|---|---|
| 1089592 | 3/1955 | France | 123/41.13 |

*Primary Examiner*—Craig R. Feinberg
*Assistant Examiner*—W. R. Wolfe
*Attorney, Agent, or Firm*—Lane, Aitken & Kananen

[57] ABSTRACT

The temperature of an internal combustion engine is controlled in accordance with engine operating conditions such as engine load and speed by controlling the temperature of a working fluid or fluids of the engine, such as engine intake air, engine cooling water and lubricating oil. To do this there are provided fluid temperature sensing means, engine condition detecting means, a control unit to produce a control signal and means for regulating the working fluid temperature in response to the control signal so as to bring the sensed working fluid temperature closer to a predetermined reference temperature which is set as being a function of engine operating conditions. Preferably the temperature control is operated in such a manner that the working fluid temperature is high at low engine load and low at high engine load.

32 Claims, 5 Drawing Figures

APPARATUS FOR CONTROLLING TEMPERATURE OF INTERNAL COMBUSTION ENGINE

BACKGROUND OF THE INVENTION

The present invention relates to an apparatus for controlling the temperature of an internal combustion engine including a spark ignition engine and a diesel engine and more particularly to an apparatus which controls the engine temperature by controlling the temperature of a working fluid or fluids capable of exchanging heat with the engine.

In a spark ignition engine, the temperature of the combustion chamber walls, in general, is too low under a low load condition and this leads to incomplete combustion and provides more unburned components, such as HC and CO, in the exhaust gases. Under a high load condition, on the other hand, increasing the compression ratio to improve the fuel consumption causes an increasing knock tendency.

In a diesel engine, the ignition lag is large during idling so that what is called diesel knock is liable to occur. And since the heat load is severe under high load condition, there is a necessity for a more rigid structure of the engine which eventually makes the engine more heavy and expensive.

It is one of the major factors causing these undesired problems that the temperature of the combustion chamber walls and the temperature of the intake air are too low at low load and too high at high load.

In a conventional engine cooling system, the temperature of the cooling water to cool the combustion chamber walls is controlled constant at about 80° C. Accordingly the combustion chamber walls are cooled excessively at low load while on the contrary cooling is insufficient at high load. And the engine intake air is warmed up only during a warm-up period in some cases but there has never been provided means for cooling the intake air at high load. So far there is no idea of controlling the temperature of a working fluid or fluids, such as engine intake air, engine coolant and lubricating oil, of the engine to a desired temperature varying in accordance with the engine operating conditions and therefore the undesired problems mentioned above are considered to be unavoidable.

SUMMARY OF THE INVENTION

It is an object of the present invention to provide an apparatus for controlling the temperature of an internal combustion engine which can provide an optimum engine performance by controlling the temperature of a working fluid or fluids of the engine to a target temperature varying in accordance with engine operating conditions, such as engine load and engine speed.

The apparatus for controlling the temperature of an internal combustion engine according to the present invention controls one or more of the working fluids, such as engine intake air, engine coolant and lubricating oil, which are capable of exchanging heat with the engine, to control the temperature of the engine. To do this, fluid temperature sensing means senses the temperature of a working fluid and on the other hand condition detecting means detects the engine operating conditions. Reference means, such as a part of a programmed computer, receives information from the condition detecting means and finds a predetermined reference temperature of the working fluid which reference temperature is a function of the engine operating conditions. Controller means, such as a part of a programmed computer, receives information from the fluid temperature sensing means and from the reference means, compares the temperature sensed by the fluid temperature sensing mean with the reference temperature found by the reference means to find the error therebetween and produces a control signal in accordance with the error. The temperature of the working fluid is controlled by fluid temperature regulating means in response to the control signal which is manipulated so as to bring the temperature of the working fluid closer to the reference temperature. For more precise temperature control, it is optional to provide a plurality of fluid temperature sensing means and a plurality of fluid temperature regulating means. The reference temperature may be high at low engine load and low at high engine load or may be lower in a low engine speed range than in a high engine speed range.

DESCRIPTION OF THE PREFERRED EMBODIMENTS

Figure 1:
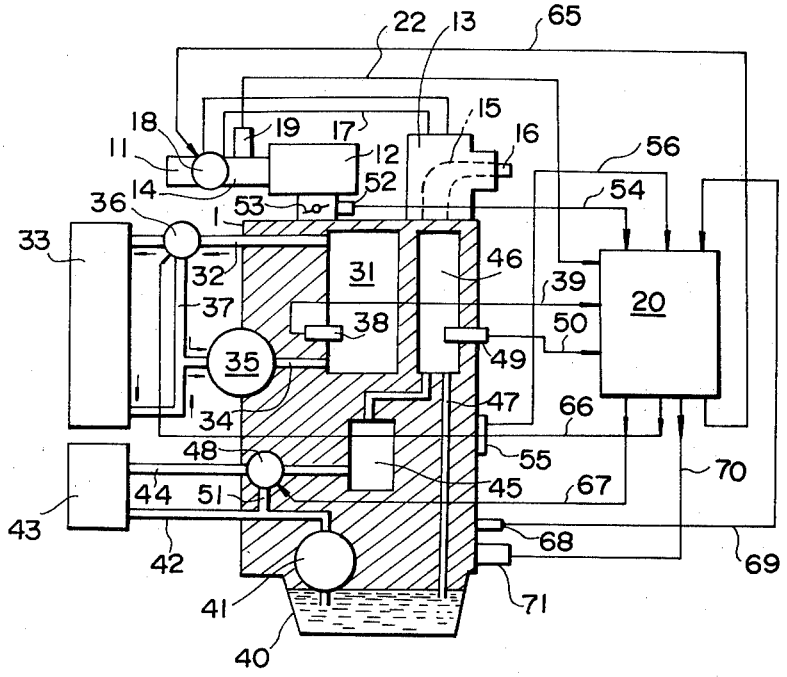
FIG. 1 is a schematic illustration of an apparatus embodying the present invention for a spark ignition engine.

In FIG. 1, intake air, cooling water and lubricating oil are shown as working fluids of an engine 1.

Air is sucked from an air inlet 11 and flows through an air cleaner 12 and an induction passage 14 and into a combustion chamber of the engine 1. The exhaust gases from the combustion chamber are discharged through an exhaust passage 15 and out of an outlet 16. The heat of the exhaust gases is transferred to the air in a heat exchanger 13 and the hot air warmed in the heat exchanger 13 is introduced through a hot air passage 17 to the induction passage 14. There is provided an intake air temperature control valve 18 at a junction of the induction passage 14 and the hot air passage 17 to control the intake air temperature by controlling the mixture ratio of the cool air from the air inlet 11 and the hot air from the hot air passage 17. The controlled temperature of the mixed air is sensed by an intake air temperature sensor 19 disposed downstream of the intake air temperature control valve 18 and the sensor 19 converts the sensed temperature into an electric signal and sends it to a computer 20 via a temperature signal line 22.

An engine cooling water flows through an engine water jacket 31 in the engine 1 and is introduced through an upper water passage 32 to a radiator 33 where the heat of the cooling water is dissipated. After being cooled in the radiator 33, the cooling water is returned to the engine water jacket 31 through a lower water passage 34 and circulates through the engine. A water pump 35 provides the force that causes water to flow.

There is provided in the upper water passage 32 a water temperature control valve 36 of an electric type which stops or restricts the flow of the cooling water to the radiator 33 and instead allows a part or whole of the cooling water to go through a water bypass passage 37 which detours the radiator 33 and leads to a portion of the lower water passage 34 between the radiator 33 and the water pump 35.

Thus the water flowing through the bypass passage 37 does not undergo the heat release process in the radiator and maintains its relatively high temperature while the water flowing through the radiator is cooled through the heat release process. The cool water from the radiator and the hot water from the bypass passage join together at the portion of the lower water passage 34 and its mixture ratio is controlled by the water temperature control valve 36. In this way the temperature of the water flowing through the engine water jacket is controlled.

A water temperature sensor 38 placed adjacent to the engine water jacket 31 senses the temperature of the cooling water in the engine water jacket 31 and produces an electric signal representative of the sensed temperature, and sends it to the computer 20 via a temperature signal line 39.

Engine lubricating oil is drawn from an oil pan 40 formed in the lower part of the engine 1 by an oil pump 41 and introduced through an oil passage 42 to an oil cooler 43. After being cooled in the oil cooler 43, the oil flows through an oil passage 44 and an oil filter 45 and into an engine lubricating system 46. Flowing through the engine lubricating system 46, the oil performs its tasks in many parts of the engine 1, and after that, drains through an oil passage 47 into the oil pan 40.

There is provided in the oil passage 44 an oil temperature control valve 48 which allows a controlled amount of the oil to go through an oil bypass passage 51 bypassing the oil cooler 43 and connecting the two oil passages 42 and 44 while the remaining portion of the oil continues to flow through the oil cooler 43. Thus the temperature of the oil going through the engine lubricating system 46 is controlled by controlling the mixture ratio of the oil of a relatively high temperature from the oil bypass passage 51 and the oil of a relatively low temperature from the oil cooler 44. An oil temperature sensor 49 placed adjacent to the engine lubricating system 46 senses the temperature of the oil to produce a temperature signal and sends the temperature signal to the computer 20 via a temperature signal line 50.

As will be understood from the foregoing description, the working fluids to be controlled in this embodiment, that is, the intake air, the cooling water and the lubricating oil, are controlled by the fluid temperature control valves, that is, the air temperature control valve, the water temperature control valve and the oil temperature control valve, respectively, which regulate the mixture ratio of a hot working fluid and a cool working fluid.

In this embodiment, engine load and engine speed are detected to estimate engine operating conditions. To detect engine load there is provided in the induction passage 14 a load sensor 52 for sensing the negative pressure (intake manifold vacuum) near a throttle valve 53. The load sensor 52 converts the measured vacuum into a proportional electric signal and feeds it to the computer 20 via a condition signal line 54. On the other hand, engine speed is sensed by a rotational speed sensor 55 which produces an electric signal representative of the sensed speed and sends it to the computer 20 via a condition signal line 56.

The desired reference temperatures for the intake air, the cooling water and the lubricating oil are predetermined depending on the engine operating conditions indicated by engine load and speed and these data are stored in the computer 20. The computer compares the sensed fluid temperature with the reference temperature individually for each of the working fluids and produces a control signal based on the comparison for each of the working fluids. The control signals are sent via control signal lines 65, 66 and 67, respectively, to the air temperature control valve 18, the water temperature control valve 36 and the oil temperature control valve 48.

Furthermore there is provided an ignition timing control system in this embodiment. The ignition timing of the engine is sensed from the terminals of the secondary winding of the ignition coil by an ignition timing sensor 68 and its output signal is sent to the computer 20 via a signal line 69. The computer 20 produces a control signal in response to the output signal from the ignition timing sensor 67 and sends the control signal via a control signal line 70 to an ignition timing control device 71. The ignition timing control device 71 advances or retards the ignition timing in response to the control signal.

The control apparatus arranged in this way is operated as follows.

The computer receives information on the engine operating conditions from the load sensor 52 and the engine speed sensor 55 and finds each reference temperature for the working fluids which is a function of the engine operating conditions. The computer 20 also receives the temperature signals from the fluid temperature sensors 19, 38 and 49 and compares each of the fluid temperature with its reference temperature to find its error therebetween. And then the computer 20 produces each control signal for the working fluids in accordance with its error and sends it to the corresponding fluid temperature control valve 18, 36 or 48. The control signals are modulated in such a manner as to force the sensed fluid temperature to approach its reference temperature.

The reference temperature for each of the working fluids is determined depending on the engine operating conditions as follows, for example.

As for the relationship between engine load and fluid temperature, the reference temperature of the working fluid is made high at low engine load (at idling or under road load condition) and low at high engine load. In the case of a cooling water in a water cooled engine, its reference temperature is made high (but below the boiling temperature) under low load condition and made low, 60° C., for example, under high load condition. For a cooling water including ethylene glycol, the upper temperature limit can be increased up to 120° C. The reference temperature for engine lubricating oil is determined in a similar manner. The reference temperature for intake air can be set as low as atomospheric temperature or lower than that if an air conditioning refrigeration system is utilized.

Figure 2:
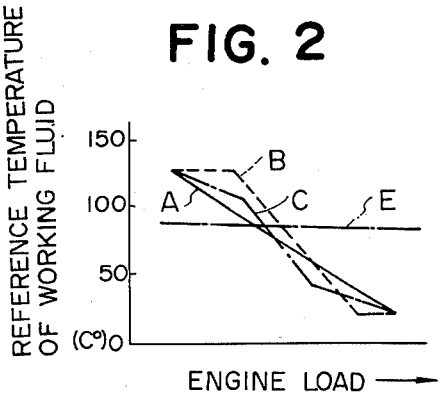
FIG. 2 shows some examples of the relationship between a reference temperature of a working fluid and engine load.

The reference temperature of the working fluid is related to engine load in various ways, as shown in FIG. 2. The reference temperature of the working fluid is in a linear relationship with engine load, as in a line A, or constant in some load ranges as in a line B, or the gradient of temperature versus engine load is varied in different load ranges as in line C. Line E indicates a conventional method in which the reference temperature is maintained constant in the whole load range.

Figure 3A:
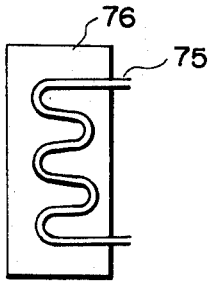
FIGS. 3A and 3B are schematic views of a heat exchanger using a refrigerant of an air conditioning system to cool a working fluid.
Figure 3B:
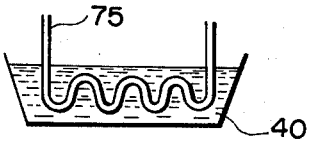

For cooling the working fluid to the low reference temperature, cooling by atomospheric air is usually sufficient, but in some cases, as in a hot climate, it becomes insufficient. In such cases where more cooling capacity is required, a refrigerant of an air conditioning refrigeration system is available for cooling the intake air, the cooling water and the lubricating oil. In a heat exchanger shown in FIG. 3A, a refrigerant passage 75 is immersed in a cooling water in a container 76 formed in the engine cooling water passage. In a heat exchanger shown in FIG. 3B, the refrigerant passage 75 is immersed in lubricating oil in the oil pan 40. Thus the temperature controls of the cooling water and the lubricating oil are achieved at the same time by controlling the temperature of the refrigerant flowing into the heat exchangers.

As for the relationship between engine speed and fluid temperature, the reference temperature is made lower in a low speed range than in a high speed range for the condition of constant engine load. In a spark ignition engine, there is a greater tendency toward knocking at lower engine speed and therefore it is preferable to lower the reference temperature at lower engine speed. With an increase of engine speed, the heat release per unit time length from the engine becomes greater and therefore, greater cooling capacity is required. Therefore it is preferable to make the reference temperature relatively low at high engine speed.

In the embodiment described above, the intake air, the cooling water and the lubricating oil are employed as working fluids to be controlled and the temperatures of these working fluids are controlled all together so that remarkable results can be obtained. However, if a more simplified control system is desired, only one or two is selected from these working fluids for the temperature control. For example, the cooling water and the intake air are controlled to a desired reference temperature in accordance with the engine operating conditions for reducing HC emission and the tendency of the engine to knock.

EGR gas, or exhaust gas recirculated back to the intake system, is another example of the working fluid of the engine.

Temperature sensors used in various other control systems can be used for the fluid temperature sensors 19, 38 and 49 in this embodiment. Thermocouple, thermistor, bimetal, bellows and thermowax are the main types of temperature sensors available for the present purpose.

For monitoring engine load as a parameter of engine operating conditions, many measurable variables are available. For example, there are opening degree of a throttle valve, engine intake manifold vacuum, flow rate of incoming air-fuel mixture and engine speed, flow rate of fuel and engine speed, pressure in an exhaust passage, depression degree of an accelerator pedal, combustion chamber pressure, and maximum combustion chamber pressure.

Engine speed can be determined, for example, by measuring rpm of a crankshaft, camshaft or distributor, or speed of timing chain or belt or other driving belt, or by counting the number of teeth passing through a reference position per unit time length for a timing gear or a chain or ring gear of a flywheel.

An analog computer is advantageous as a control unit when a control pattern is not varied or when controlled variables are few. When a digital computer is employed as a control unit, a variety of control patterns are easily designed only by changing a part of ROM, and various other quantities than temperature are easily controlled by a single control unit. In the case of a digital computer, analog signals from sensors must be converted into a digital form.

The controls of the fluid control valves 18, 36 and 48 may be made in accordance with an on-off system. Such a control system exhibits a shortened settling time and an improved response of control and therefore is suitable for an automotive engine in which engine operating conditions vary constantly. The fluid control valves 18, 36 and 48 may be controlled in accordance with an analog system by regulating a sectional area of a fluid passage and in this case a temperature change is made gradual.

The ignition timing sensor 68 and the ignition timing control device 71, as shown in FIG. 1, are operated when the temperature control of the working fluid is insufficient as in the case of high load condition at high ambient temperature. In such a case the ignition timing sensor 68 senses the ignition timing and the computer determines the proper timing depending on the engine operating conditions and sends a command signal to the ignition timing control device 71 to retard the ignition firing point in accordance with the difference between the working fluid temperature and the reference temperature. In this way the combustion temperature can be lowered and the working fluid temperature can be brought closer to the target temperature indirectly, so that the tendency to knock is reduced. Thus the ignition timing control is connected organically to the working fluid temperature control and therefore a flexible engine operating characteristic is obtained. In the case of a diesel engine, the fuel injection timing is controlled for the same purpose.

Figure 4:
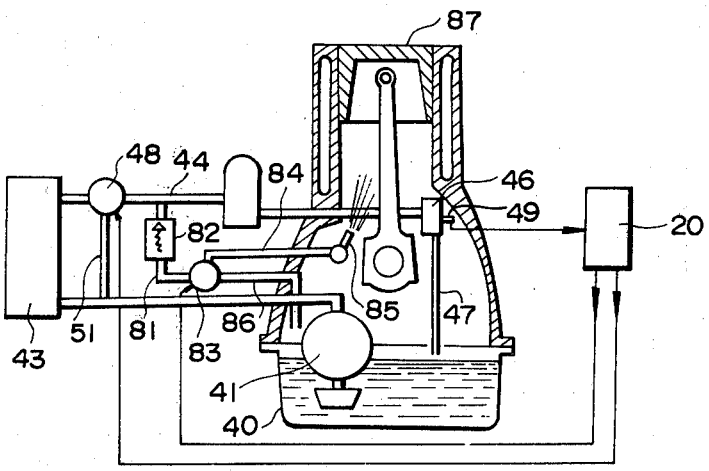
FIG. 4 is a schematic illustration of one example of a control system for system for controlling the temperature of lubricating oil.

FIG. 4 shows another example of the engine lubricating oil circulation system. In FIG. 4, there is provided a branch passage in the lubricating oil circulation system. An oil passage 81 branches off from the oil passage 44 at a point downstream of the oil temperature control valve 48 and leads through a pressure regulating valve 82 to a switching valve 83. The switching valve 83 is arranged to select either of two oil passages, one of which is an oil passage 86 leading to the oil pan 40 and the other of which is an oil passage 84 leading to a nozzle 85 which injects the oil toward the backside of the combustion chamber. The computer 20 controls the switching valve 83.

With this arrangement, the computer 20 commands the switching valve 83 to open the oil passage 84 when high engine load is detected. Then the oil flows through the oil passage 84 to the nozzle 85 and the oil is injected to the underside of a piston 87 of the engine to cool the top land of the piston 87 so that the heat load at high load is lessened and that the tendency to knock is reduced. Under low load condition, the switching valve 83 opens the oil passage 86 and therefore the oil returns to the oil pan 40 without cooling the combustion chamber. This example of the oil circulation system is particularly suitable to a supercharged engine.

As will be understood from the foregoing description, a working fluid or fluids of an internal combustion engine, according to the present invention, is controlled so as to bring its temperature closer to a desired temperature which is predetermined depending upon engine operating conditions, so that many remarkable advantages are obtained, as follows.

(1) In a premixed air/fuel mixture, spark ignition engine, lowering of the working fluid temperature improves knock resistance and provides knock free engine operation with high compression ratio, thus offering increased maximum engine output power and improved fuel economy.

(2) Heat load exerted an engine structural member such as a piston which constitutes a combustion chamber is reduced at high load condition by lowering the working fluid temperature. Accordingly there is no need for making such engine structural member much more rigid even for an engine having a high compression ratio, diesel engine and supercharged engine, and this provides a less heavy engine and a wider freedom of selecting material for such structural member.

(3) In a premixed air/fuel mixture engine, a burning charge is cooled and quenched at a thin boundary layer adjacent to a combustion chamber surface and unburned hydrocarbon in these unburned surface charge is expelled as unburned hydrocarbon emission. According to the present invention, such a HC emission is reduced by increasing a combustion chamber temperature at medium load condition to reduce the thickness of such a boundary layer.

(4) In a compression ignition engine, there is a large ignition lag at idling condition, which leads to a diesel knock. According to the present invention a combustion chamber temperature is increased by controlling the working fluid temperature to promote evaporation of fine droplets of liquid fuel, so that ignition lag is decreased.

(5) According to the present invention, engine temperature which is one of the most important engine variables is controlled in accordance with engine operating conditions, so that it is possible to improve many other engine operating characteristics.

What is claimed is:

1. An apparatus for controlling the temperature of an internal combustion engine, comprising:

fluid temperature sensing means for sensing the temperature of a working fluid of the engine which is capable of exchanging heat with the engine, said working fluid being the exhaust gas of the engine which is recirculated to the intake system of the engine, condition detecting means for detecting the engine operating conditions, reference means for continuously finding, in response to the engine operating conditions detected by said condition detecting means, a predetermined reference temperature of said working fluid which is varied according to a function of the engine operating condition, controller means which compares the temperature sensed by said fluid temperature sensing means with the reference temperature found by said reference means to find the error therebetween and produces a control signal in accordance with said error, fluid temperature regulating means for regulating the temperature of said working fluid in response to said control signal which is manipulated so as to bring the temperature of said working fluid closer to said reference temperature.

2. An apparatus for controlling the temperature of an internal combustion engine, comprising:

fluid temperature sensing means for sensing the temperature of a working fluid of the engine which is capable of exchanging heat with the engine, said working fluid being the lubricating oil of the engine, condition detecting means for detecting the engine operating conditions, reference means for continuously finding, in response to the engine operating conditions detected by said condition detecting means, a predetermined reference temperature of said working fluid which is varied according to a function of the engine operating condition, controller means which compares the temperature sensed by said fluid temperature sensing means with the reference temperature found by said reference means to find the error therebetween and produces a control signal in accordance with said error, fluid temperature regulating means for regulating the temperature of said working fluid in response to said control signal which is manipulated so as to bring the temperature of said working fluid closer to said reference temperature.

3. An apparatus according to claim 2, wherein said fluid temperature regulating means comprises a fluid temperature control valve which is capable of controlling the mixture ratio of a hot flow of said working fluid warmed by the heat of the engine and a cool flow of said working fluid having a temperature lower than the hot flow so as to supply said working fluid of the controlled temperature to the engine.

4. An apparatus according to claim 2, wherein said condition detecting means comprises a load sensor for sensing the engine load and a speed sensor for sensing the engine speed.

5. An apparatus according to claim 4, wherein said working fluid is the engine lubricating oil, and wherein said fluid temperature regulating means further comprises a switching valve having an inlet into which a portion of said working fluid from said outlet of said fluid temperature control valve is arranged to flow and an outlet, and a nozzle arranged to spray the lubricating oil upward to the underside of the piston of the engine to cool the engine, said outlet of said switching valve being connected to said nozzle to supply the lubricating oil to the nozzle, said switching valve being controlled in response to said load sensor in such a manner that said outlet of said switching valve is opened only when the sensed engine load is above a predetermined engine load.

6. An apparatus for controlling the temperature of an internal combustion engine, comprising;

a plurality of fluid temperature sensing means each for sensing the temperature of each one of different kinds of working fluids which are capable of exchanging heat with the engine, condition detecting means for detecting the engine operating conditions, means for finding, in response to the detected engine operating conditions, each reference temperature of said working fluids which is a function of the engine operating conditions, controller means which compares the sensed temperature of each of said working fluids with the corresponding reference temperature to find the error therebetween and produces each control signal of said working fluids in accordance with the corresponding error, a plurality of fluid temperature regulating means each for regulating the temperature of each one of said working fluids in response to the corresponding control signal which is manipulated so as to bring the temperature of the working fluid closer to the reference temperature.

7. An apparatus according to claim 6, wherein said working fluids comprise the intake air of the engine and the exhaust gas of the engine which is recirculated to the intake system of the engine.

8. An apparatus according to claim 6, wherein said working fluids comprise the coolant of the engine and the exhaust gas of the engine which is recirculated to the intake system of the engine.

9. An apparatus according to claim 6, wherein said working fluids comprise the lubricating oil of the engine and the exhaust gas of the engine which is recirculated to the intake system of the engine.

10. An apparatus according to claim 6, wherein said condition detecting means comprises a load sensor for sensing the engine load and a speed sensor for sensing the engine speed.

11. An apparatus according to claim 6, wherein said reference temperature is high at low engine load and low at high engine load.

12. An apparatus according to claim 6, wherein said reference temperature is lower in a low engine speed range than in a high engine speed range.

13. An apparatus according to claim 6, wherein said apparatus further comprises an ignition timing control means which can retard the ignition timing of the engine in accordance with said error of at least one of said working fluids so as to lower the engine temperature when the temperature of the working fluid is above the reference temperature.

14. An apparatus according to claim 6, wherein said apparatus further comprises a fuel injection timing control means which can retard the fuel injection timing of the engine in accordance with said error of at least one of said working fluids so as to lower the engine temperature when the temperature of the working fluid is above the reference temperature.

15. An apparatus according to claim 6, wherein said working fluids comprises the intake air of the engine, the coolant of the engine and the lubricating oil of the engine.

16. An apparatus according to claim 6, wherein said working fluids comprise the intake air of the engine and the coolant of the engine.

17. An apparatus according to claim 6, wherein said working fluids comprise the intake air of the engine and the lubricating oil of the engine.

18. An apparatus according to claim 6, wherein said working fluids comprise the coolant of the engine and the lubricating oil of the engine.

19. An apparatus according to claim 15, 16, 17 or 18, wherein said working fluids further comprise the exhaust gas of the engine which is recirculated to the intake system of the engine.

20. An apparatus according to claim 6, wherein each of said fluid temperature regulating means comprises a fluid temperature control valve which is capable of controlling the mixture ratio of a hot flow of each one of said working fluid warmed by the heat of the engine and a cool flow of that fluid having a temperature lower than said hot flow so as to supply the working fluid of the controlled temperature to the engine.

21. An apparatus according to claim 20, wherein said working fluid comprises the engine lubricating oil, and wherein said fluid temperature regulating means for the engine lubricating oil further comprises a switching valve having an inlet into which a portion of said working fluid from said outlet of said fluid temperature control valve is arranged to flow and an outlet, and a nozzle arranged to spray the lubricating oil upward to the underside of the piston of the engine to cool the engine, said outlet of said switching valve being connected to said nozzle to supply the lubricating oil to the nozzle, said switching valve being controlled in response to said load sensor in such a manner that said outlet of said switching valve is opened only when the sensed engine load is above a predetermined engine load.

22. An apparatus according to claim 20, wherein at least one of said fluid temperature regulating means further comprises cooling means for cooling one of said working fluids supplied to said fluid temperature control valve as the cool flow.

23. An apparatus according to claim 22, wherein said cooling means comprises a heat exchanger to cool said working fluid by means of the refrigerant of an air conditioner refrigeration system.

24. An apparatus for controlling the temperature of an internal combustion engine, comprising:

fluid temperature sensing means for sensing the temperature of a working fluid of the engine which is capable of exchanging heat with the engine, condition detecting means for detecting the engine operating conditions, reference means for continuously finding, in response to the engine operating conditions detected by said condition detecting means, a predetermined reference temperature of said working fluid which is varied according to a function of the engine operating condition, controller means which compares the temperature sensed by said fluid temperature sensing means with the reference temperature found by said reference means to find the error therebetween and produces a control signal in accordance with said error, fluid temperature regulating means for regulating the temperature of said working fluid in response to said control signal which is manipulated so as to bring the temperature of said working fluid closer to said reference temperature, said fluid temperature regulating means comprising timing control means capable of retarding the timing of ignition of the engine in accordance with said error so as to lower the engine temperature when the temperature of the working fluid is above the reference temperature while maintaining a predetermined normal ignition timing schedule of the engine when the temperature of the working fluid is below the reference temperature.

25. The apparatus as set forth in claim 24 wherein the engine is a spark ignition engine and wherein said timing control means is means for controlling the spark timing.

26. The apparatus as set forth in claim 24 wherein the engine is a Diesel engine and wherein said timing control means is means for controlling the fuel injection timing.

27. An apparatus according to claim 24, 25 or 26, wherein said reference temperature is high at low engine load and low at high engine load.

28. An apparatus according to claim 24, 25 or 26, wherein said working fluid is the engine intake air.

29. An apparatus according to claim 24, 25 or 26, wherein said working fluid is the coolant of the engine.

30. An apparatus according to claim 24, 25 or 26, wherein said working fluid is the lubricating oil of the engine.

31. An apparatus according to claim 24, 25 or 26, wherein said working fluid is the exhaust gas of the engine which is recirculated to the intake system of the engine.

32. An apparatus according to claim 24, 25 or 26, wherein said fluid temperature regulating means comprises a fluid temperature control valve which is capable of controlling the mixture ratio of a hot flow of said working fluid warmed by the heat of the engine and a cool flow of said working fluid having a temperature lower than the hot flow so as to supply said working fluid of the controlled temperature to the engine.

* * * * *